US007459648B2

(12) United States Patent
Asai

(10) Patent No.: US 7,459,648 B2
(45) Date of Patent: Dec. 2, 2008

(54) RECORDING APPARATUS

(75) Inventor: Yasuyuki Asai, Setagaya-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/565,379

(22) Filed: Nov. 30, 2006

(65) Prior Publication Data

US 2007/0133190 A1 Jun. 14, 2007

(30) Foreign Application Priority Data

Dec. 12, 2005 (JP) ..... 2005-357992

(51) Int. Cl.
*H01H 9/18* (2006.01)

(52) U.S. Cl. ..... 200/310; 200/314; 200/317

(58) Field of Classification Search ..... 200/310, 200/314, 317; 341/22, 23; 345/168–170; 362/24, 29, 30, 88; 455/90.3; 463/36–38
See application file for complete search history.

(56) References Cited

U.S. PATENT DOCUMENTS 6,224,221 B1 * 5/2001 Glienicke ..... 362/23
6,522,147 B1 * 2/2003 Pickard et al. ..... 324/414
6,590,147 B2 * 7/2003 Kassabian ..... 84/422.1
6,855,899 B2 * 2/2005 Sotome ..... 200/317
7,129,432 B2 * 10/2006 Fujii et al. ..... 200/314
7,193,170 B2 * 3/2007 Katayama et al. ..... 200/314
7,244,898 B2 * 7/2007 Kim ..... 200/314
7,253,369 B2 * 8/2007 Fu et al. ..... 200/310

FOREIGN PATENT DOCUMENTS

JP 2000-280585 A 10/2000
JP 2003-094765 A 4/2003

* cited by examiner

*Primary Examiner*—Michael A Friedhofer
(74) *Attorney, Agent, or Firm*—Canon U.S.A., Inc. I.P. Division

(57) ABSTRACT

A device is provided which includes a substrate arranged in an interior thereof having a light emitting element positioned on an upper surface of the substrate; and a push button assembly disposed in an exterior structure of the device above the emitting element. The button assembly includes a cylindrical light guide for receiving/guiding light to an annular display part disposed on an upper portion of the light guide. The light guide is further defined by a lower end, and an inner and outer wall. A portion of the outer wall proximate to the lower end has a tapered surface portion. A push button part is movably disposed within the light guide. The emitting element is positioned coincident with a center axis of the light guide. Light emitted by the element is received by the light guide, reflected by the tapered portion, and guided towards the display part.

9 Claims, 11 Drawing Sheets

RECORDING APPARATUS

BACKGROUND OF THE INVENTION

1. Field of the Invention

The present invention relates to a recording apparatus, and more particularly, relates to a structure of an operation key which is provided in an exterior of the recording apparatus, and has a display part and an operation part.

2. Description of the Related Art

In information processing apparatuses, such as office computers, personal computers, and/or a word processors, display devices for displaying various information about a status of the apparatus have been conventionally used. Also in image recording apparatuses or image reading apparatuses such as printers, copying machines, printing devices, facsimile machines, and/or scanners, similar display devices have been used.

The display device is generally arranged in an exterior of the device where the display device is easily viewed. In recent years, as the information apparatuses are personalized, the size of the devices has become miniaturized and the prices of the devices have been reduced. The personal computer, the word processor, or the printer which is an output device for them have conventionally been used on a desktop. However, because of the recent miniaturization, these devices have become portable and can now be easily carried about. As a result, devices which can be driven by a battery have become more practical and prevalent.

On a display panel in the exterior of the devices, an illumination device is often provided which functions as a display device for notifying a user of operation status such as on/off of an operation key. In the illumination device, an end surface under a light guide (inside of the device) made of acrylic resin or the like is generally arranged opposite to a light emitting element such as a light emitting diode. Light enters through the end surface of the lower part of the light guide, and the light guide emits the light from an end surface on the opposite side. The end surface that emits the light forms a display part of the device. In an operation part of the device such as an operation key, around which the display part is arranged, a status of operation, for example, on/off, can be displayed.

FIGS. 10A to 10C are longitudinal sectional views illustrating a conventional display device. An opening 905 is formed in a panel 900 of an exterior, and an operation part (for example, an operation key) is formed within the opening 905. A circular member 850 for light shielding is arranged in an interior of a cylinder-shaped light guide 800. A circuit board 950 is arranged in an interior of the panel 900 and a light emitting diode 910 (i.e., a light emitting element) is mounted on the circuit board 950. The light emitting diode 910 is arranged under the center of the cylinder-shaped light guide 800. Radial light (light flux) 915 which is emitted from the light emitting diode 910 enters through a lower part of the light guide 800. The incident light is repeatedly refracted and reflected in a light guiding part in the light guide 800, and reaches a display part 810 at an upper end. As a result, the light which reaches the display part 810 can be viewed by a user. The display part 810 displays the on/off state of the operation part (operation key). In the display part 810, as the amount of the light that reaches the display part 810 increases, the visibility increases accordingly.

FIGS. 10A to 10C further illustrate varying states of optical paths when a distance between a lower end 820 of the light guide 800 and the light emitting diode 910 varies in an axis direction (a height direction) to P, 2×P, and 3×P. As illustrated in FIG. 10A, if the distance between the light guide 800 and the light emitting diode 910 is P which is relatively short distance, the number of reflection times in the light guide 800 is large, and the amount of light that reaches the display part 810 is relatively small. As illustrated in FIG. 10B, if the distance is set to 2×P which is twice as long, the number of reflection times in the light guide 800 decreases, and the amount of light that reaches the display part 810 increases. Further, as illustrated in FIG. 10C, if the distance is set to 3×P which is three times as long, the number of reflection times in the light guide 800 further decreases, and the amount of light that reaches the display part 810, further increases.

FIG. 11 is a longitudinal sectional view illustrating another conventional display device. In lower portions of the cylindrical light guide 800, a plurality of the light emitting diodes 910 are arranged along a circular lower end of the light guide 800. The structure illustrated in FIG. 11 is different from the structure illustrated in FIG. 10 in this respect, however, in other respects, the structure of FIG. 11 is otherwise similar to FIG. 10. In the structure illustrated in FIG. 10, the number of reflection times in the light guide 800 is decreased and the amount of the light that reaches the display part 810 is increased in order to increase the visibility. For that purpose, the distance between the light guide 800 and the light emitting diodes 910 has to be large as illustrated in FIGS. 10B and 10C. As a result, it is not possible to achieve both the improvement of the visibility and slimming-down of the display device at the same time.

In the structure illustrated in FIG. 11, by reducing the number of reflection times in the light guide 800, the above-described disadvantage of the structures illustrated in FIGS. 10A to 10C can be eliminated. That is, even in a case where the distance between the light guide 800 and the light emitting diode 910 is short, by reducing the number of reflection times in the light guide 800, the amount of the light that reaches the display part 810, can be sufficiently ensured. However, in the structure illustrated in FIG. 11, because the plurality of light emitting diodes 910 are necessary in one display part 810, the cost and the power consumption of the device increase. For example, in a battery-operated printer, the increase of the power consumption shortens operating time of the printer.

SUMMARY OF THE INVENTION

The present invention is directed to a recording apparatus provided with a display device which has a compact and inexpensive structure and is excellent in visibility.

According to an aspect of the present invention, a device is provided including a substrate arranged in an interior of the device having a light emitting element positioned on an upper surface of the substrate and a push button assembly disposed in an exterior structure of the device above the light emitting element. The push button assembly includes a cylindrical light guide for receiving and guiding the light from the light emitting element to an annular display part disposed on an upper portion of the cylindrical light guide for displaying the light, the cylindrical light guide being further defined by a lower end, an inner wall and an outer wall, wherein a portion of the outer wall proximate to the lower end has a tapered surface portion; and a push button part movably disposed within the cylindrical light guide, wherein the push button part is adapted to be depressed by an operator. The light emitting element is positioned generally coincident with a center axis of the cylindrical light guide. Light emitted by the light emitting element is received by the cylindrical light guide, reflected by the tapered surface portion, and guided towards the annular display part.

According to another aspect of the present invention, a portion of the inner wall proximate to the lower end of the cylindrical light guide is further defined by a second tapered surface portion, thereby giving the lower end of the cylindrical light guide a generally frustro-conical shape.

According to yet another aspect of the present invention, the device may further include a switch positioned on the upper surface of the electric substrate configured to be at least sometimes in physical communication with an abutting part integrally formed to the cylindrical light guide, the abutting part radially extending away and down from the outer wall of the cylindrical light guide.

Moreover, according to another aspect of the present invention, the device may further include a stopper integrally formed with the exterior structure, and wherein the push button assembly further includes a support part which abuts the stopper part to control movement of the push button assembly.

Furthermore, according to another aspect of the present invention, an inside portion of the annular display part is shielded from the guided light.

Additionally, according to another aspect of the present invention, a recording apparatus configured to record on a recording medium using a recording unit. The recording apparatus includes a substrate arranged in an interior of the recording apparatus having a light emitting element positioned on an upper surface of the substrate; and a push button assembly disposed in an exterior structure of the recording apparatus above the light emitting element. The push button assembly includes a cylindrical light guide for receiving and guiding the light from the light emitting element to an annular display part disposed on an upper portion of the cylindrical light guide for displaying the light, the cylindrical light guide being further defined by a lower end, an inner wall and an outer wall, wherein a portion of the outer wall proximate to the lower end has a tapered surface portion; and a push button part movably disposed within the cylindrical light guide, wherein the push button part is adapted to be depressed by an operator. The light emitting element is positioned generally coincident with a center axis of the cylindrical light guide, and the light emitted by the light emitting element is received by the cylindrical light guide, reflected by the tapered surface portion, and guided towards the annular display part.

According to still yet another aspect of the present invention, the recording unit includes an inkjet recording unit configured to form an image using the recording unit which discharges ink from a discharge opening.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will now herein be described in detail below with reference to the drawings.

Figure 1:
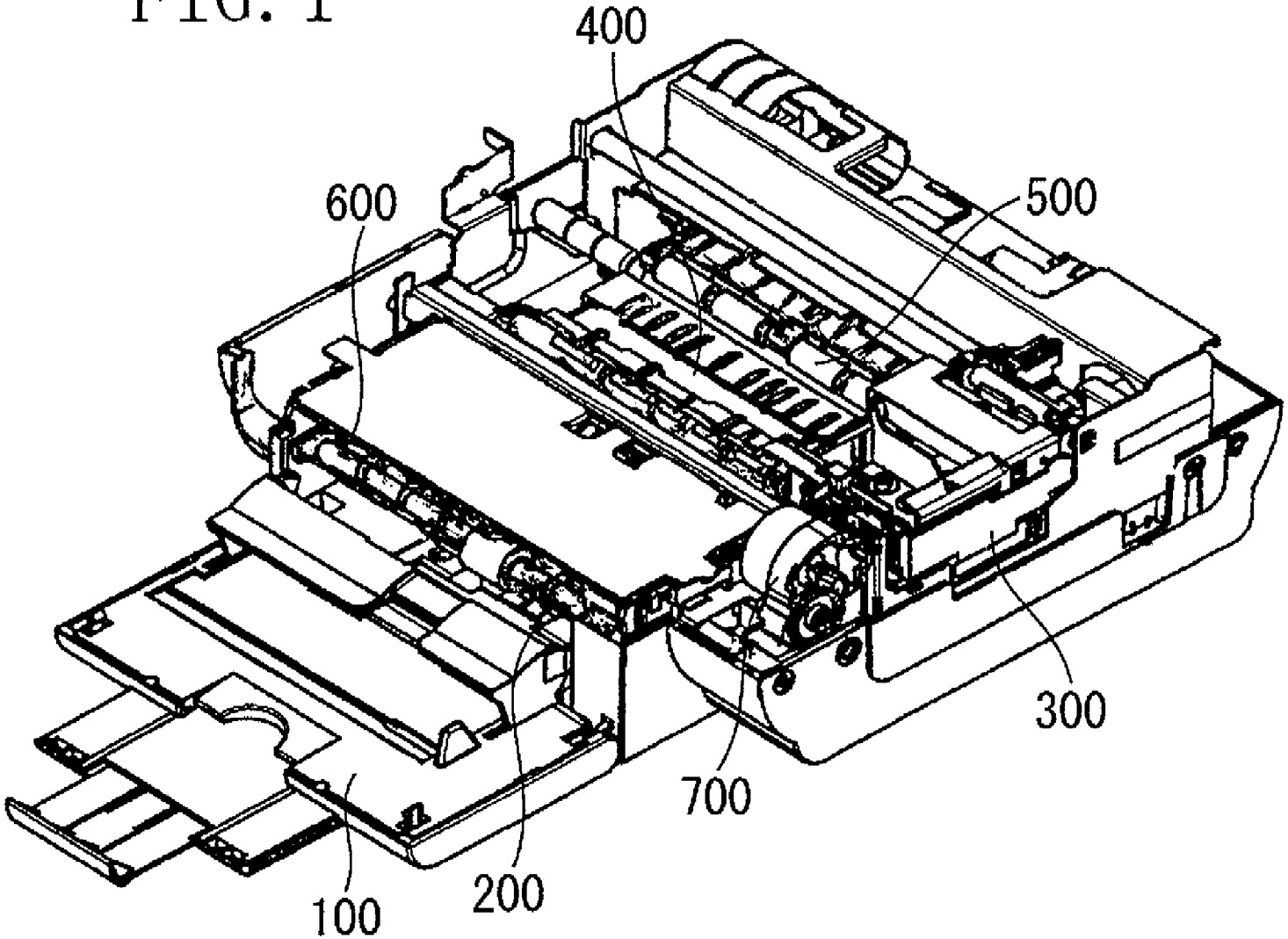
FIG. 1 is a perspective view illustrating an example internal structure of a recording apparatus according to a first exemplary embodiment of the present invention.

FIG. 1 is a perspective view illustrating an example internal structure of a recording apparatus according to a first exemplary embodiment of the present invention. In this exemplary embodiment, an inkjet recording apparatus is described, as an example, which forms an image by discharging ink from a recording head onto a recording medium such as recording paper or film based on image information. In FIG. 1, the recording apparatus includes a feeding/discharging tray 100, a separation/feeding/discharging part 200, a recording unit 300, an image forming part 400, a first roller 500, a second roller 600 and a drive transmission 700.

The feeding/discharging tray 100 includes a stack unit on which a recording medium recorded by the recording unit 300 is stacked and placed as well as a plurality of unrecorded recording media such as recording paper or recording film. The separation/feeding/discharging part 200 separates the recording media one by one and feeds the separated medium into the apparatus, and discharges the recorded recording medium onto the feeding/discharging tray 100. The recording unit 300 is a recording head which records an image on the recording medium based on image information. In this exemplary embodiment, the recording unit 300 is configured of a recording head mounted on a carriage which reciprocates along a recording medium. The image forming part 400 forms a conveying route of the recording medium, and is an area where an image is recorded on the moving recording medium by the recording head.

The first roller 500 is a conveying unit arranged at an upstream side of the image forming part 400, in a conveying direction of the recording medium when the image is formed by the recording unit 300. The second roller 600 is a conveying unit arranged in a downstream side of the image forming part 400. By these conveying units 500 and 600, the recording medium is conveyed through the image forming part 400 with a high degree of accuracy. The drive transmission part 700 includes a driving source and a drive transmission mechanism for the separation/feeding/discharging part 200. In this exemplary embodiment, the feeding/discharging tray 100 is on a front of the recording apparatus, and setting or discharge of the recording medium can be performed on the front side.

Figure 2:
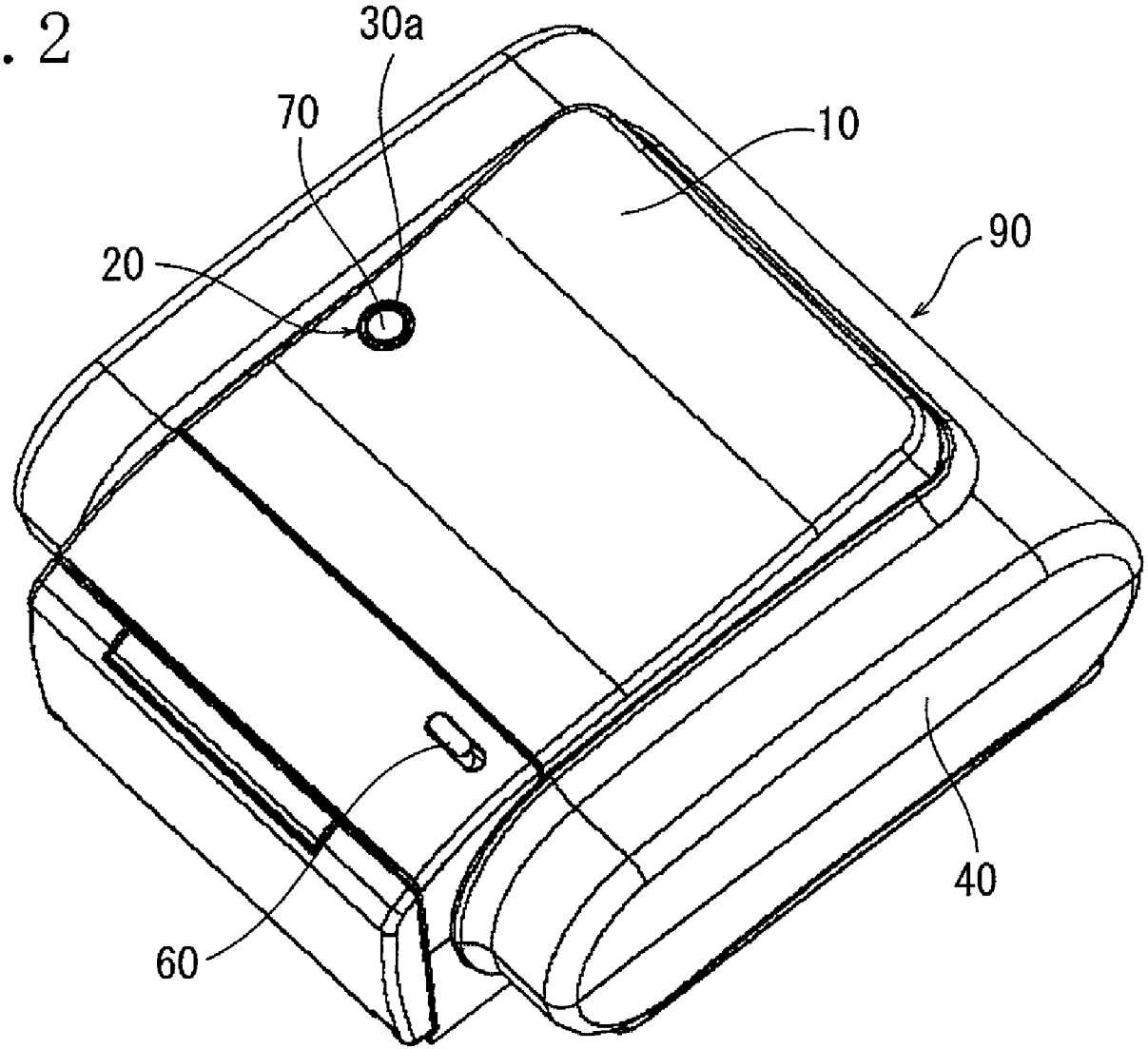
FIG. 2 is an external perspective view of an example recording apparatus according to the first exemplary embodiment of the present invention.
Figure 3:
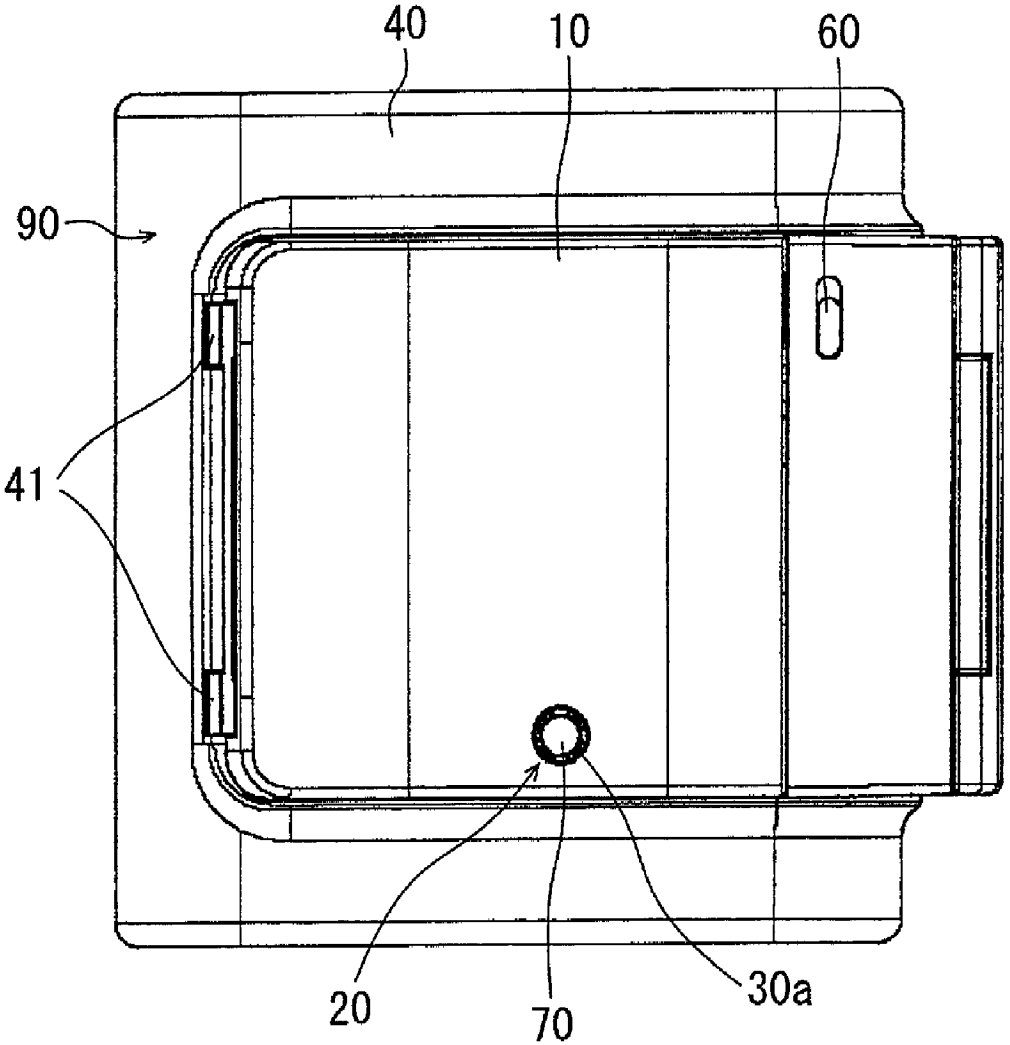
FIG. 3 is a plan view of the recording apparatus illustrated in FIG. 2.

FIG. 2 is an external perspective view of an example recording apparatus according to the first exemplary embodiment of the present invention. FIG. 3 is a plan view of the recording apparatus illustrated in FIG. 2. In FIGS. 2 and 3, on an upper surface of an upper case 40 which forms an exterior 90 of the recording apparatus, a panel 10 for operation and display is provided. On the panel 10, an operation key 20 for controlling operation of the apparatus is provided. The panel 10 is rotatable around a supporting axis 41 of the upper case 40 and can be opened or closed by operating a release key 60. On the surface of the operation key 20, a circular member 70 for light shielding and an annular display part 30*a* which surrounds the circular member 70, are provided.

Figure 4:
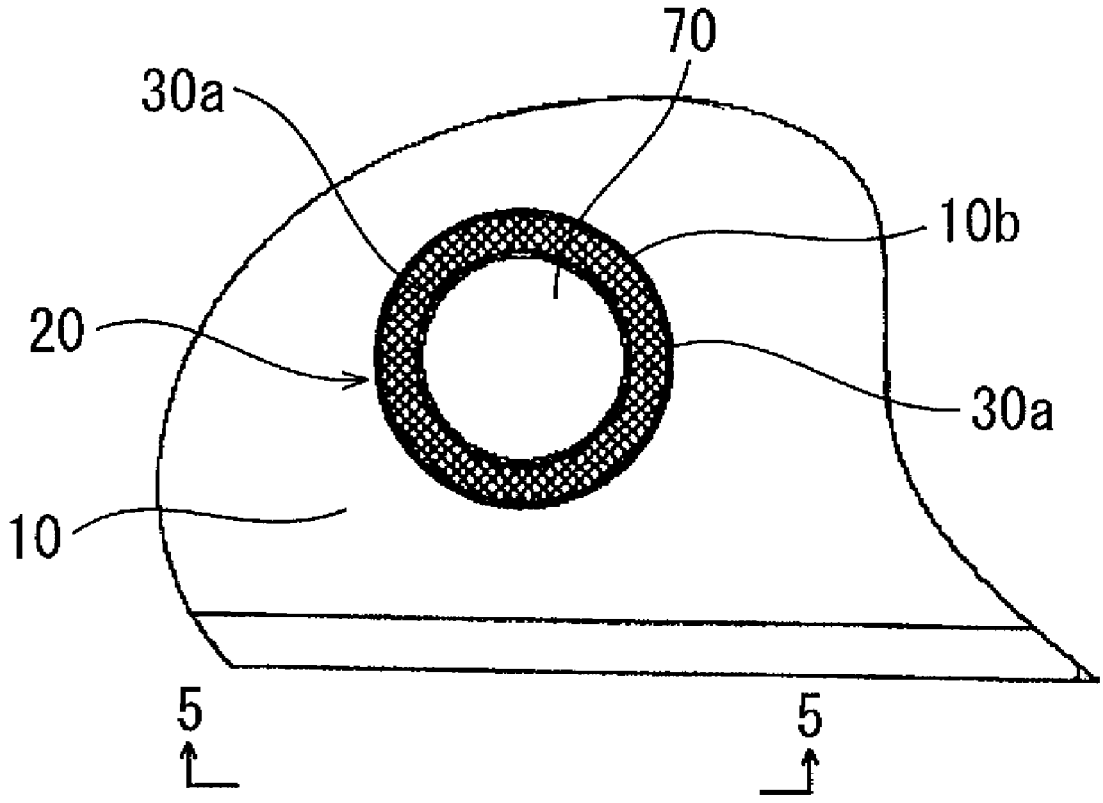
FIG. 4 is a plan view of an example operation key according to the first exemplary embodiment of the present invention.
Figure 5:
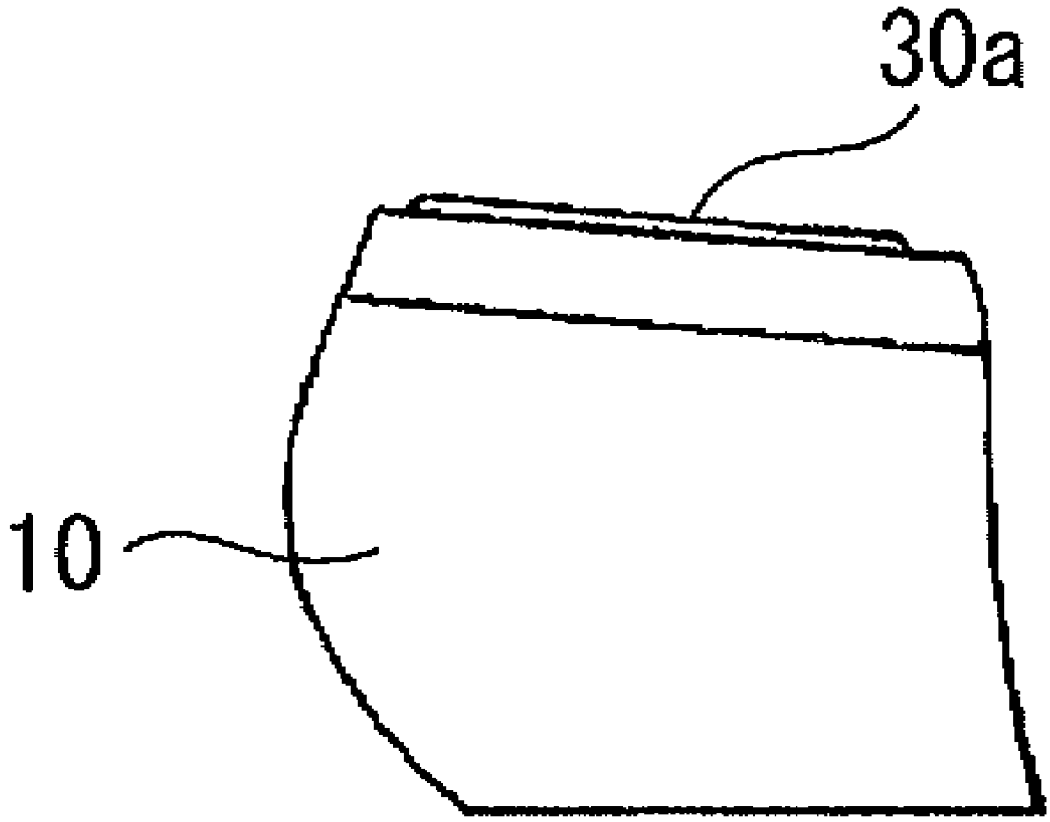
FIG. 5 is a side view of the operation key viewed in a direction indicated by arrows 5-5 in FIG. 4.
Figure 6:
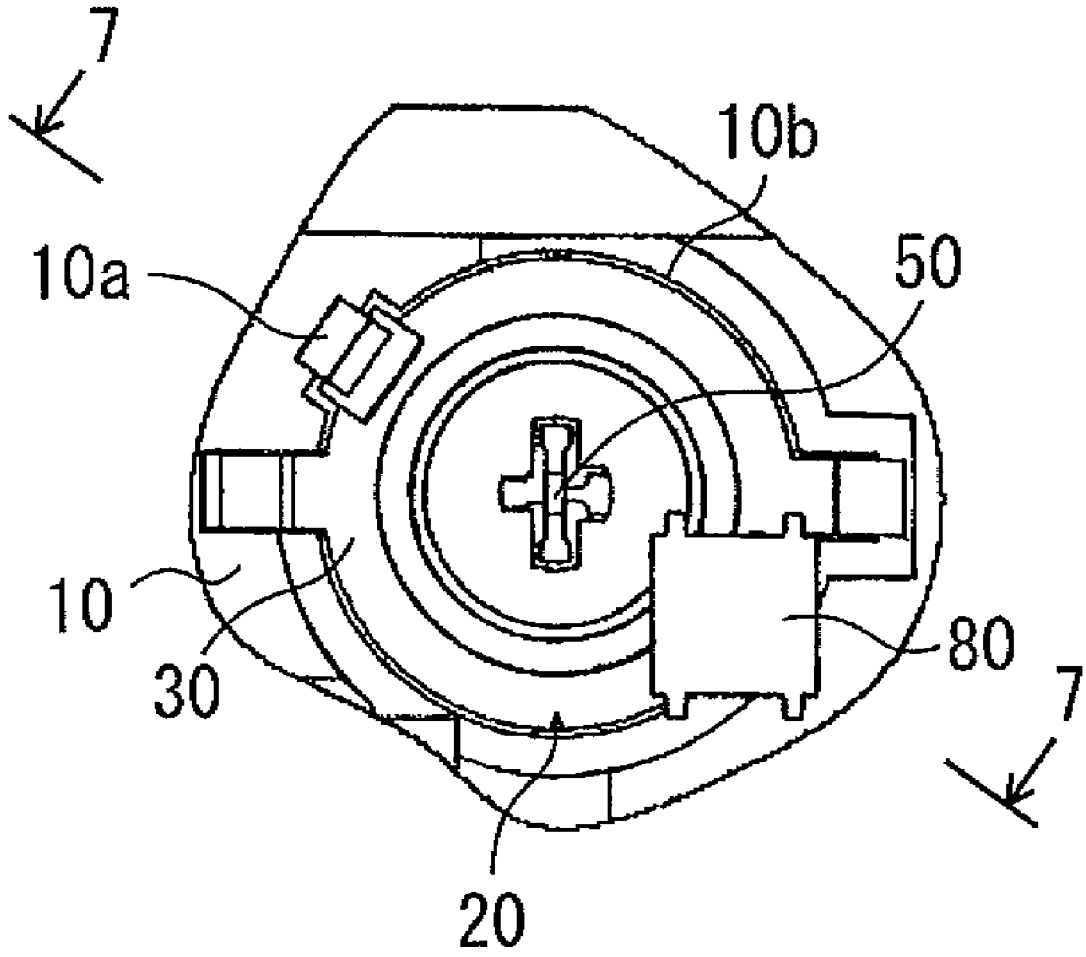
FIG. 6 is a bottom view showing the operation key illustrated in FIG. 4 viewed from a back surface side of a panel.
Figure 7:
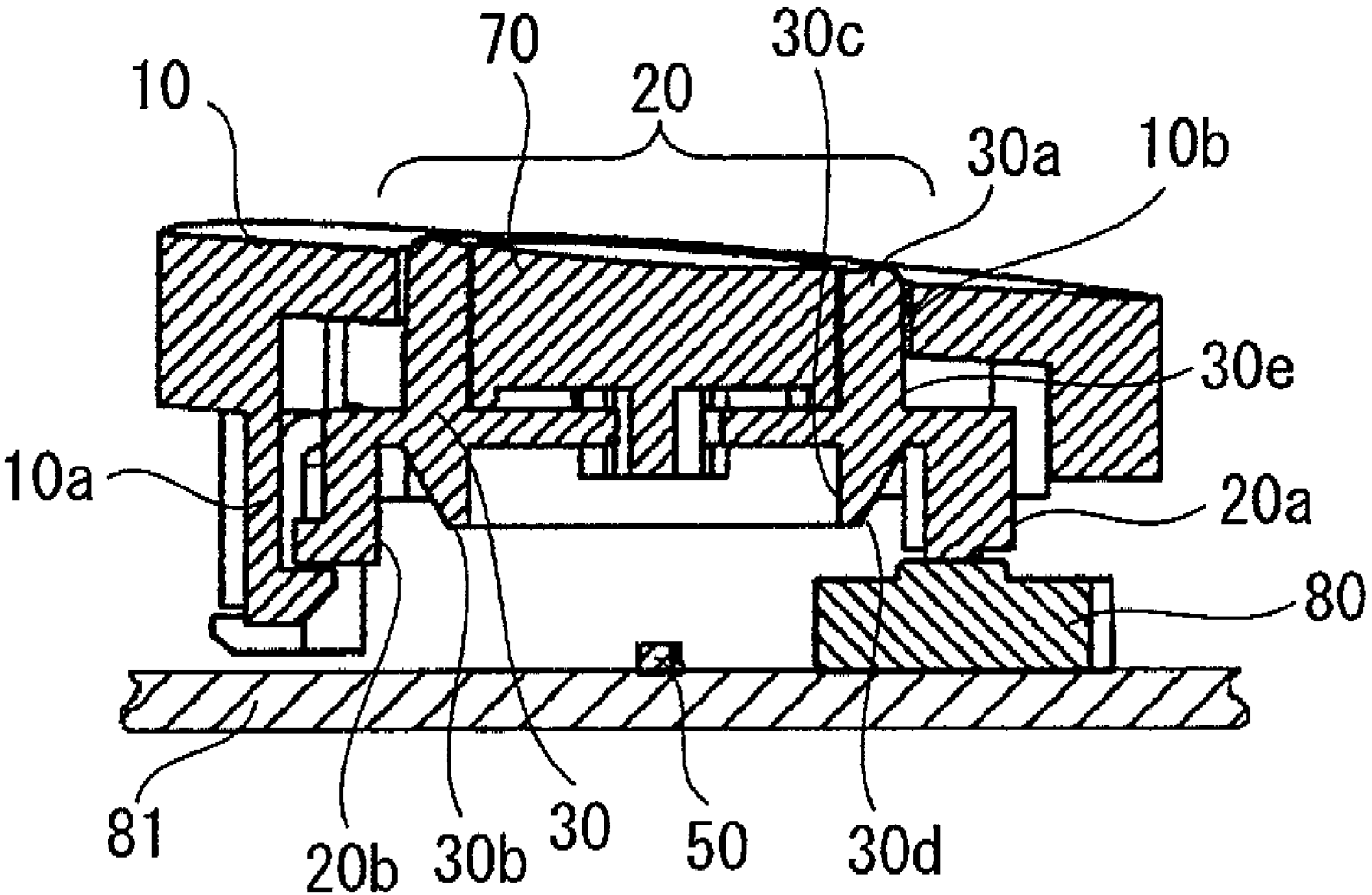
FIG. 7 is a longitudinal sectional view of the operation cut along the line 7-7 of FIG. 6.
Figure 8:
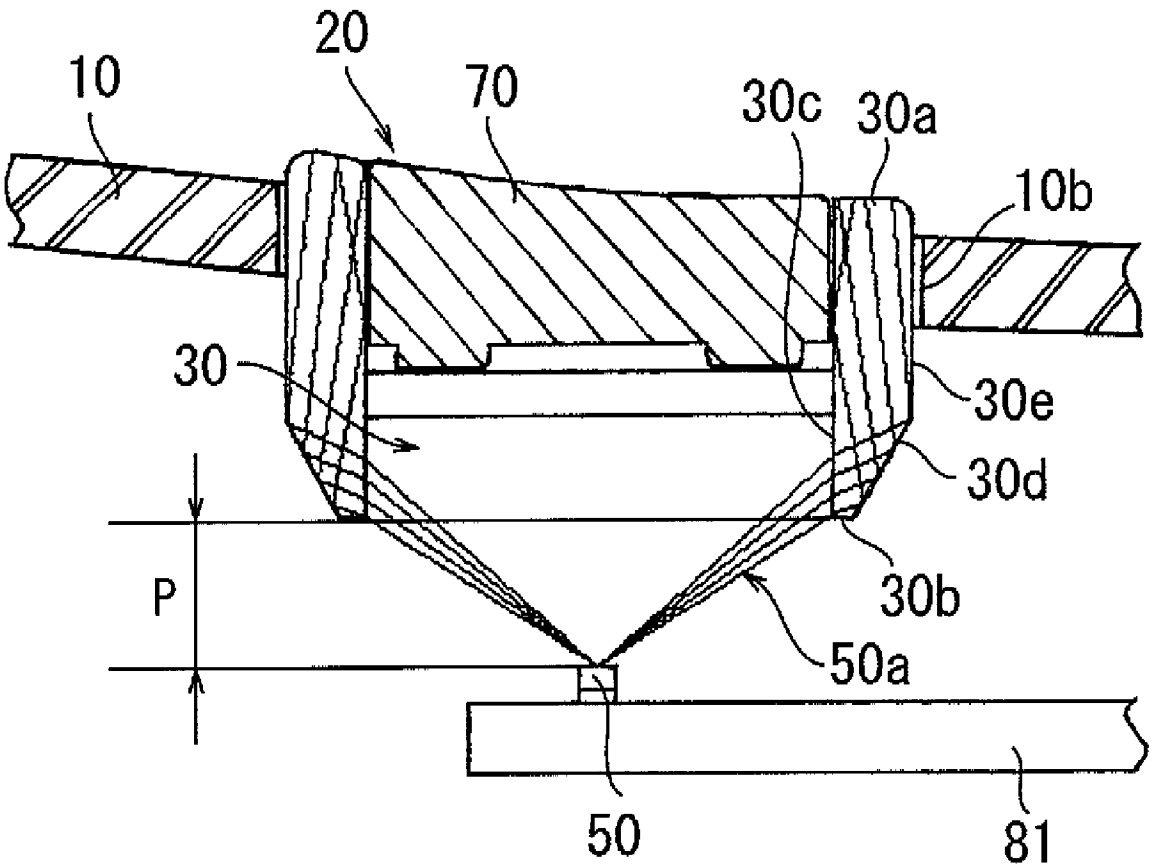
FIG. 8 is an explanatory view illustrating example optical paths according to the first exemplary embodiment of the present invention.

FIG. 4 is a plan view of the operation key 20 according to the first exemplary embodiment of the present invention. FIG. 5 is a side view, viewed in a direction indicated by arrows 5-5 in FIG. 4. FIG. 6 is a bottom view showing the operation key 20 illustrated in FIG. 4, viewed from a back side of the panel 10. FIG. 7 is a longitudinal sectional view cut along the line 7-7 of FIG. 6. FIG. 8 is an explanatory view illustrating optical paths according to the first exemplary embodiment of the present invention. In FIGS. 4 to 8, the operation key 20 which is an operation unit of the recording apparatus, includes the circular member 70 for light shielding at the center, and the annular display part 30*a* around the circular member 70. The display part 30*a* displays a status of the recording apparatus with illumination light.

The display part 30*a* is formed at an upper end of the light guide 30 which has a cylindrical shape to accommodate the circular member 70 for light shielding, and protrudes from the surface of the panel 10 of the exterior 90. The cross-sectional shape of the cylindrical light guide 30 can be either a round or a polygon. The light guide 30 guides incident light from a light emitting element 50 through a light guiding part to the display part 30*a*. The light emitting element 50 is mounted on a circuit board 81 arranged within the device. The light guide 30 emits the light from the display part 30*a*. As the light emitting element 50, for example, a light emitting diode is used. On the circuit board 81, a switch 80 is mounted.

In this embodiment, as an exemplary case, the operation key 20 functions as a key for starting up the recording apparatus. When the operation key 20 is depressed, the switch 80 is turned on and the recording apparatus is started up. Then, the light emitting diode 50 emits light to display the start-up status of the recording apparatus. The light emitted from the light emitting diode 50 is guided through the light guide 30 and given off from the display part 30*a*. Thus, the user can be aware of the start-up of the recording apparatus. The light guide 30 is formed of, for example, a diffusion member or a transparent lens. In a case of the diffusion member, the light guide 30 is formed of a material which has a high transmittance such as acrylic resin or polyethylene resin containing diffusion particles. Meanwhile, in a case of the transparent lens, the light guide 30 is formed of a material which has a high transmittance such as transparent acrylic resin.

The display part 30*a* according to this exemplary embodiment displays on/off status of the operation key 20. However, the display part 30*a* is not limited to such function. The display part 30*a* can display various status of the apparatus. For example, the display part 30*a* can display an operation status of a printer or occurrence of printer trouble. Display devices which employ such a light emitting element can be used in information devices for various purposes including a desktop information device. When the display device is used in compact and slim devices, the display device itself is required to be slim and compact. Accordingly, the device should have a slim and compact structure and light should be efficiently guided toward the light emitting part of the light guide 30.

In FIGS. 4 to 8, the operation key 20 includes the cylindrical light guide 30 which has the annular display 30*a*, and the circular member 70 for light shielding which is accommodated in the light guide 30. The operation key 20 is inserted into an opening 10*b* formed in the panel 10. The operation key 20 includes a pressing part 20*a* which abuts on the switch 80 and a supporting part 20*b* which is provided on an opposite side of the switch 80. In this exemplary embodiment, the pressing part 20*a* and the supporting part 20*b* are integrally formed with the light guide 30. Within the opening 10*b* of the panel 10, a stopper 10*a* is provided which can engage with the supporting part 20*b* of the operation key 20.

When the operation key 20 is depressed, the supporting part 20*b* comes in contact with the stopper 10*a* and the operation key 20 turns around the contact point which serves as a supporting axis. Then, the pressing part 20*a* of the operation key 20 comes in contact with the switch 80 on a substrate 81. By using the turnable operation key 20, on/off operation of the switch 80 is performed. In the operation key 20, if the switch 80 is turned on, the light emitting diode 50 on the circuit board 81 emits light. The light emitting diode 50 is arranged at a lower side under the center line of the cylindrical light guide 30 and at a relatively small distance P from a lower end 30*b* of the light guide 30. That is, the light emitting diode 50 is arranged in the vicinity of the incident part of the light guide 30 so that highly directional light enters into the light guide 30. The switch 80 is arranged in the vicinity of the light emitting diode 50.

In this exemplary embodiment, the circular member 70 for light shielding and the light guide 30 are configured as individual parts. However, a shielding process utilizing printing, stamping, or plating can be performed to the center of the light guide 30. Alternatively, the operation key 20 can be split, for example, the circular member 70 can be configured as a key member which can be depressed, and the light guide 30 which includes the display part 30*a*, can be configured as a fixed member. In this exemplary embodiment, an inclined plane 30*d* which has a chamfered shape is formed in the vicinity of a lower end of an outer wall of the light guide 30.

With reference to FIG. 8, an optical path of the light from the light emitting diode 50 is described. The light enters into the light guide 30 and is emitted from the display part 30*a*. In FIG. 8, when the operation key 20 is depressed and the switch is turned on, light flux 50*a* emitted from the light emitting diode 50 is floodlighted with a directivity to a certain area. The distance between the lower end 30*b* of the light guide 30 and the light emitting diode 50 in an axis direction is set to be the distance P. The distance P is a relatively small distance which is shown in a conventional example. The light emitting diode 50 is arranged right under the center of the cylindrical light guide 30, or in the vicinity of the center of the cylindrical light guide 30.

The light flux 50*a* emitted from the light emitting diode 50 enters into the light guide 30 through a lower part of an inner wall 30*c* of the light guide 30 which is an incident part. The incident light is substantially totally reflected at an inclined plane 30*d* formed in an outer wall 30*e* of the light guide 30. The inclined plane 30*d* is a tapered plane which tapers to the light emitting diode 50 side. The light reflected at the inclined plane 30*d* is emitted from the display part 30*a* after passing through an optical path in the light guide 30. An angle of the inclined plane 30*d* of the light guide 30 is set to a predetermined value depending on the directivity of the light emitting diode 50, the refraction index of a material which forms the light guide 30, etc. In such a case, the light substantially totally reflected at the inclined plane 30*d* is, as illustrated in FIG. 8, guided to the display part 30*a* in a substantially straight line without being reflected on the way.

According to this exemplary embodiment, by providing the inclined plane 30*d*, even if the distance between the cylindrical light guide 30 and the light emitting diode 50 in the axis direction is short and only one light emitting diode is used, the incident light can be efficiently guided to the display part 30*a*. That is, by reducing the number of reflection of the light while using the inner wall of the cylindrical light guide 30 as the incident part, even if the distance between the light emitting diode 50 and the display part 30*a* is shortened, the incident light can be efficiently guided to the display part 30*a*. Thus, the display device and the recording apparatus can be slimmed-down and miniaturized.

Figure 9:
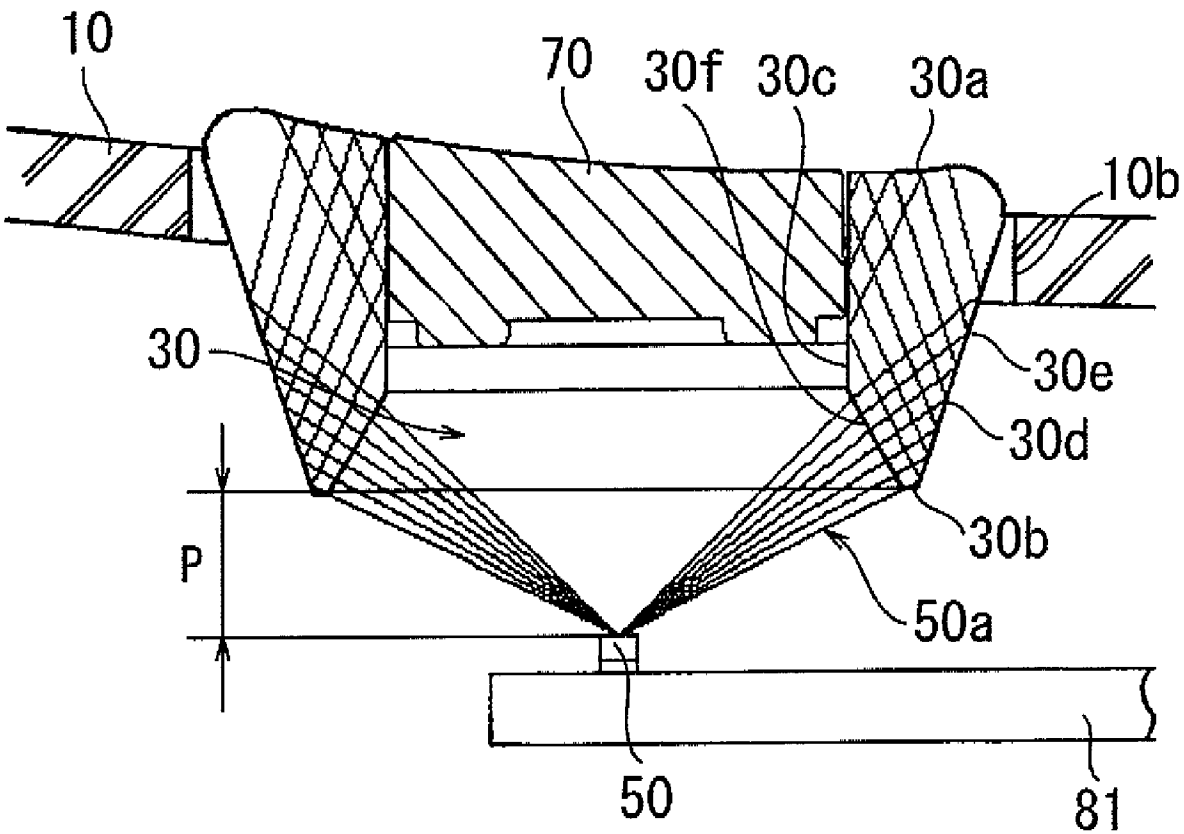
FIG. 9 is an explanatory view illustrating example optical paths according to a second exemplary embodiment of the present invention.
Figure 10A:
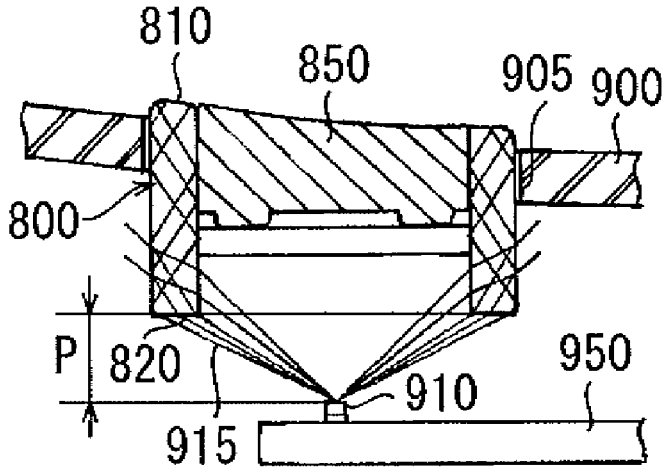
FIG. 10A (PRIOR ART)
FIGS. 10A-C are longitudinal sectional views illustrating a conventional display device.
Figure 10B:
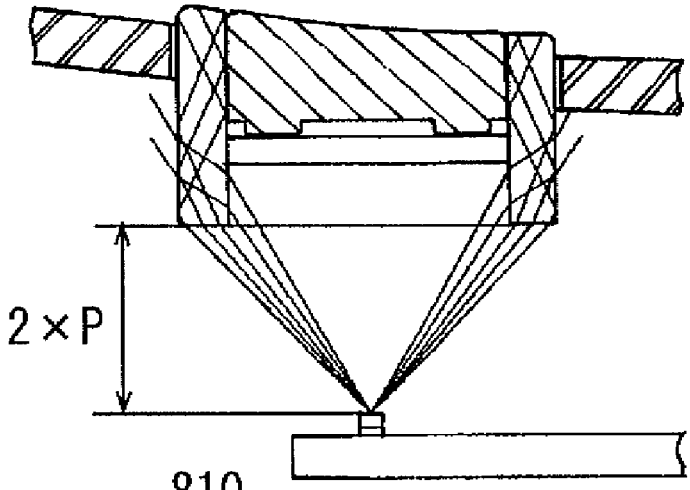
FIG. 10B (PRIOR ART)
Figure 10C:
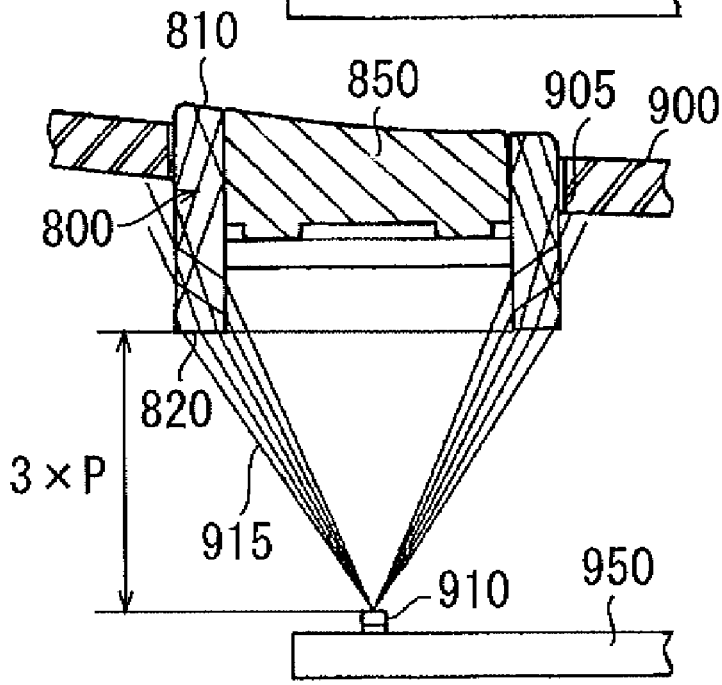
FIG. 10C (PRIOR ART)
Figure 11:
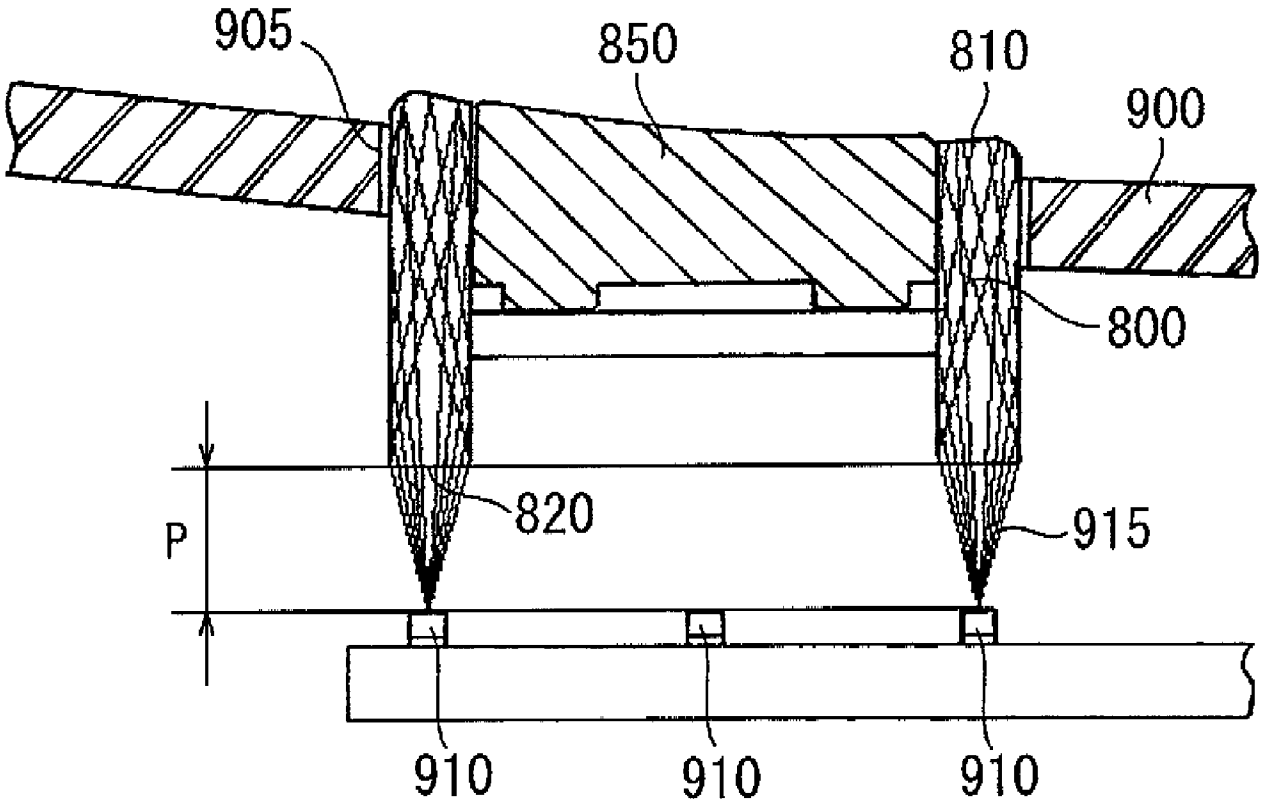
FIG. 11 (PRIOR ART)
FIG. 11 is a longitudinal sectional view illustrating another conventional display device.

FIG. 9 is an explanatory view illustrating optical paths according to a second exemplary embodiment of the present invention. In FIG. 9, an inclined plane 30*f* which expands in a direction toward the light emitting diode 50 side, is formed in the inner wall 30*c* of the light guide 30. The inclined plane 30*d* is formed which is tapered in the direction in which a diameter is reduced, to the light emitting diode 50 side. The inclined plane 30*d* according to this exemplary embodiment is formed in the almost entire outer wall 30*e*. In this exemplary embodiment, the light flux 50*a* floodlighted from the light emitting diode 50 enters through the inclined plane 30*f* of the inner wall 30*c* of the light guide 30, and the incident light is substantially totally reflected at the inclined plane 30*d* of the outer wall 30*e*. The substantially totally reflected light is emitted from the display part 30*a* after passing through the inside of the light guide 30.

In the second exemplary embodiment, by providing the inclined planes to both of the inner wall and the outer wall of the light guide 30, the incident light can be effectively guided to the display part 30*a*. Accordingly, also in the second exemplary embodiment, similarly to the first exemplary embodiment, even if the distance between the cylindrical light guide 30 and the light emitting diode 50 in the axis direction is short and only one light emitting diode is used, the incident light can be efficiently guided to the display part 30*a*. Thus, the display device can be slimmed-down and miniaturized. The each angle of the inclined plane 30*d* and 30*f* of the light guide 30 according to the second exemplary embodiment is set to predetermined values depending on the directivity of the light emitting diode 50, the refraction index of the material which forms the light guide 30, etc.

In the above-described exemplary embodiments, the display device according to the present invention is applied, as an example, to the inkjet recording apparatus which forms an image on recording medium by discharging ink from a discharge opening formed on a discharge face of a recording head. However, the display device according to the present invention can also be applied to recording devices other than the inkjet recording apparatus as long as the apparatus form an image using an image forming unit based on image information. According to each exemplary embodiment of the present invention, even with one light emitting element, the incident light which enters into the light guide, can be effectively guided to the display part, and the display device can be provided which has the compact and inexpensive structure and is excellent in visibility.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2005-357992 filed Dec. 12, 2005, which is hereby incorporated by reference herein in its entirety.

What is claimed:

1. A device comprising:

a substrate arranged in an interior of the device having a single light emitting element positioned on an upper surface of the substrate; and a push button assembly disposed in an exterior structure of the device and centered above the single light emitting element, the push button assembly comprising, a cylindrical light guide centered above the single light emitting element, the cylindrical light guide for receiving and guiding the light from the single light emitting element to an annular display part disposed on an upper portion of the cylindrical light guide for displaying the light, the cylindrical light guide being further defined by a lower end, an inner wall, an outer wall, a first inclined plane disposed on the outer wall and configured for guiding the light emitted by said single light emitting element to said annular display part, and a second inclined plane disposed on an end portion on the lower end of the inner wall and configured for guiding the light emitted by said single light emitting element to the first inclined plane; and a push button part disposed at a position centered above said single light emitting element and formed integrally with said cylindrical light guide.

2. The device according to claim 1, further comprising a switch positioned on the upper surface of the electric substrate configured to be at least sometimes in physical communication with an abutting part integrally formed to the cylindrical light guide, the abutting part radially extending away and down from the outer wall of the cylindrical light guide.

3. The device according to claim 2, further comprising a stopper integrally formed with the exterior structure, and wherein the push button assembly further includes a support part which abuts the stopper part to control movement of the push button assembly.

4. The device according to claim 1, wherein an inside portion of the annular display part is shielded from the guided light.

5. A recording apparatus configured to record on a recording medium using a recording unit, the recording apparatus comprising:

a substrate arranged in an interior of the recording apparatus having a single light emitting element positioned on an upper surface of the substrate; and a push button assembly disposed in an exterior structure of the recording apparatus and centered above the single light emitting element, the push button assembly comprising, a cylindrical light guide centered above the single light emitting element, the cylindrical light guide for receiving and guiding the light from the single light emitting element to an annular display part disposed on an upper portion of the cylindrical light guide for displaying the light, the cylindrical light guide being further defined by a lower end, an inner wall, an outer wall, a first inclined plane disposed on the outer wall and configured for guiding the light emitted by said single light emitting element to said annular display part, and a second inclined plane disposed on an end portion on the lower end of the inner wall and configured for guiding the light emitted by said single light emitting element to the first inclined plane; and a push button part disposed at a position centered above said single light emitting element and formed integrally with said cylindrical light guide.

6. The recording apparatus according to claim 5, further comprising a switch positioned on the upper surface of the electric substrate configured to be at least sometimes in physical communication with an abutting part integrally formed to the cylindrical light guide, the abutting part radially extending away and down from the outer wall of the cylindrical light guide.

7. The recording apparatus according to claim 6, further comprising a stopper integrally formed with the exterior structure, and wherein the push button assembly further includes a support part which abuts the stopper part to control movement of the push button assembly.

8. The recording apparatus according to claim 5, wherein an inside portion of the annular display part is shielded from light.

9. The recording apparatus according to claim 5, wherein the recording unit comprises an inkjet recording unit configured to form an image using the recording unit which discharges ink from a discharge opening.

* * * * *